US005739523A

United States Patent [19]

Tsutsumi et al.

[11] Patent Number: 5,739,523

[45] Date of Patent: Apr. 14, 1998

[54] OBJECT SENSOR SYSTEM FOR DOORS

[75] Inventors: Koji Tsutsumi; Takashi Wada, both of Kobe, Japan

[73] Assignee: NABCO Limited, Kobe, Japan

[21] Appl. No.: 554,565

[22] Filed: Nov. 6, 1995

[30] Foreign Application Priority Data

Nov. 7, 1994 [JP] Japan ..... 6-298942
Nov. 7, 1994 [JP] Japan ..... 6-298943

[51] Int. Cl.[6] ..... G08B 13/184

[52] U.S. Cl. ..... 250/221; 340/555

[58] Field of Search ..... 250/221, 341.8, 250/342; 340/555, 556, 557

[56] References Cited

U.S. PATENT DOCUMENTS

| | | | |
|---|---|---|---|
| 4,097,733 | 6/1978 | Langenbach et al. | 250/221 |
| 4,479,053 | 10/1984 | Johnston . | |
| 4,605,850 | 8/1986 | Anselment et al. | 340/556 |
| 4,713,545 | 12/1987 | Norrgren et al. . | |
| 5,142,152 | 8/1992 | Boiucaner | 250/221 |
| 5,410,149 | 4/1995 | Winston, Jr. et al. | 250/221 |

FOREIGN PATENT DOCUMENTS

| | | |
|---|---|---|
| 31 12 529 | 11/1982 | Germany . |
| 40 04 529 | 9/1991 | Germany . |
| 355381 | 3/1991 | Japan . |
| 342230 | 9/1991 | Japan . |

OTHER PUBLICATIONS

European Search Report for EP 95 11 7540 completed 22 Feb. 1996.

*Primary Examiner*—Edward P. Westin
*Assistant Examiner*—Kevin Pyo
*Attorney, Agent, or Firm*—Duane, Morris & Heckscher LLP

[57] ABSTRACT

A light-emitter emits light, and a plano-convex condenser lens focuses the emitted light and projects the focused light onto a floor near a door to thereby establish a sensing area. A plano-convex light-receiving lens focuses light reflected from the sensing area, and a light-receiver receives the focused, reflected light. The plano-convex lenses have edges closer to the door which is substantially straight.

17 Claims, 12 Drawing Sheets

ANGLE 1

ANGLE 2

ANGLE 3

ANGLE 1

ANGLE 2

ANGLE 3

ANGLE 5

ANGLE 4

OBJECT SENSOR SYSTEM FOR DOORS

This invention relates to a door sensor system for sensing an object, such as a human, which is approaching a door, such as an automatic door.

BACKGROUND OF THE INVENTION

A door sensor, for example, an automatic door sensor, emits light from a light emitter (hereinafter referred to simply as emitter) from above the door to provide a sensing area. If light reflected from the sensing area is received by a light receiver (hereinafter referred to simply as receiver), it is determined that no object or passenger is in the sensing area. On the other hand, if the receiver does not receive any reflected light from the sensing area, it is determined that an object is in the sensing area.

An example of such door sensor systems is disclosed in Japanese Unexamined Patent Publication No. HEI 3-55381 published on Mar. 11, 1991. According to this Japanese publication, a two-sided mirror (which has two reflecting surfaces) reflect light from an emitter mounted above the door into two different directions. The two light rays from the two-sided mirror are projected onto a floor to thereby provide a first sensing area at a location closer to the door and a second sensing area at a location remote from the door. The two-sided mirror has a horizontally disposed rotation axis about which it is rotated. The directions in which the two light rays are projected can be varied by rotating the two sided-mirror about the axis to thereby change the locations of the first and second sensing areas. Another two-sided reflector mirror is disposed for the receiver, too.

The two sensing areas move together as the emitter-side reflector is rotated. It is not possible to move only the second sensing area, for example, maintaining the first sensing area at the same location. In general, the first sensing area is for sensing an object present in the vicinity of the door in order to prevent the object from being caught between the door and a door jamb. Accordingly, it is preferable that the first sensing area is stationary.

Another example of door sensor systems is shown in FIG. 3 of Japanese Examined UM Publication No. HEI 3-42230 published on Sep. 4, 1991. The sensor system shown in this publication includes first and second door sensors, each including an emitter and a receiver. The first door sensor is to sense whether any object is present in a first sensing area formed on a floor near the door, whereas the second door sensor is to sense whether any object is present in a second sensing area remoter from the door than the first sensing area. The second door sensor is disposed at a location remoter from the door than the first door sensor.

The system of this UM publication requires two door sensors. In order to change the location of the second sensing area, the location of the second door sensor must be changed. The two door sensors are often housed in a single housing, and, in such a case, the two sensors are arranged along the direction perpendicular to the plane of the closed door, which requires that the thickness of the housing be large. A thick housing is esthetically undesirable, and it sometimes makes a shutter unuseable which is installed in front of the door. Accordingly, the sensor housing should desirably be thin.

In order to provide better safety, a plurality of first sensing areas may be formed in the direction along the width of the door. For that purpose, a plurality of emitter-receiver pairs may be mounted along the door. In each of the emitters, a round, convex lens may be used to condense an emitted light ray, so that the formed first sensing areas are generally circular and juxtaposed in the direction along the width of the door.

When the first sensing areas are circular and juxtaposed in the direction along the width of the door, there may be gaps between the respective first sensing areas and the door, and if an object is in any of such gaps, it cannot be sensed. The circular first sensing areas may be formed adjacent to the door. However, unless the positions of the respective sensing areas are carefully adjusted, the door may be erroneously sensed by the sensors.

The respective first sensing areas may be formed to overlap with adjacent ones in the direction along the width of the door in order to reduce areas in which an object cannot be sensed. For that purpose, however, a larger number of emitter and receivers are necessary.

An object of the present invention is to provide a door sensor system having a plurality of sensing areas, in which the location of at least one of the sensing areas can be changed independent of other sensing areas.

Another object of the present invention is to provide a door sensor system which can be fabricated thin.

Still another object of the present invention is to provide a door sensor system which has a wide sensing zone and is free of erroneous sensing of an object, with relatively small numbers of emitters and receivers.

SUMMARY OF THE INVENTION

According to an embodiment of the present invention, a door sensing system includes light emitting means which emits light. First focusing means focuses the emitted light and directs the focused light toward a floor near a door to form a sensing area. Second focusing means focuses light reflected from the sensing area, and light receiving means receives the reflected light focused by the second focusing means. The transverse cross-section of the sensing area has a generally straight edge extending adjacent to and along the width of the door.

According to one aspect of the present invention, a door sensing system includes focusing means for focusing a heat wave emanating from the direction of the floor. Light receiving means receives the focused heat Wave. The focusing means focuses a heat wave emanating from an area having a generally straight edge extending adjacent to and along the width of the door.

According to still another aspect of the present invention, a door sensing system includes light emitting means for emitting and directing light toward a floor near a door. Splitter means splits the emitted light into a plurality light rays including at least a first light ray directed toward a first region of the floor near the door, and a second light ray directed toward a second region of the floor near the door. The first region is located along the door, and the second region is remote from the door. Shifter means shifts at least one of the split light rays in the direction perpendicular to the door independently of the remaining light rays.

Light receiving means operates when it receives at least one of the first and second light rays.

According to a still further aspect, a door sensor system includes light emitting means for emitting and directing at least first and second light rays toward first and second regions of the floor near the door. The first region is located along the door, and the second region is remote from the door. Light receiving means operates when it receives at least one of the first and second light rays reflected from the first and second regions. Limiting means limits regions reflected light rays from which are received by the light receiving means to a plurality of limited regions including the first and second regions. Shifter means shifts the limited regions in the direction perpendicular to the door, independently of other limited regions.

According to a further aspect of the present invention, a door sensor system includes heat wave receiving means disposed at a location along the width of a door. The heat wave receiving means receives a heat wave emanating from an article approaching the door.

Limiting means limits regions a heat wave from which is received by the receiving means to a plurality of regions including a first region at a location along the width of the door and a second region at a location remote from the door. Shifter means shifts the limited regions independently of other limited regions.

DETAILED DESCRIPTION OF EMBODIMENTS

A door sensor system according to a first embodiment of the present invention is now described with reference to FIGS. 1, 2 and 3.

Figure 1:
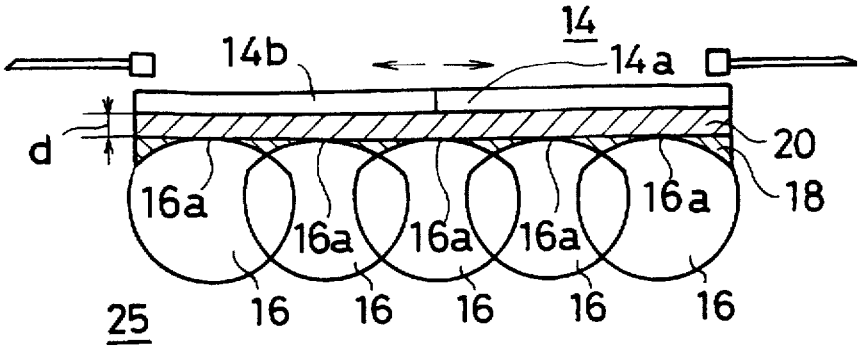
FIG. 1 shows a safety area formed by a door sensor system according to a first embodiment of the present invention.
Figure 2:
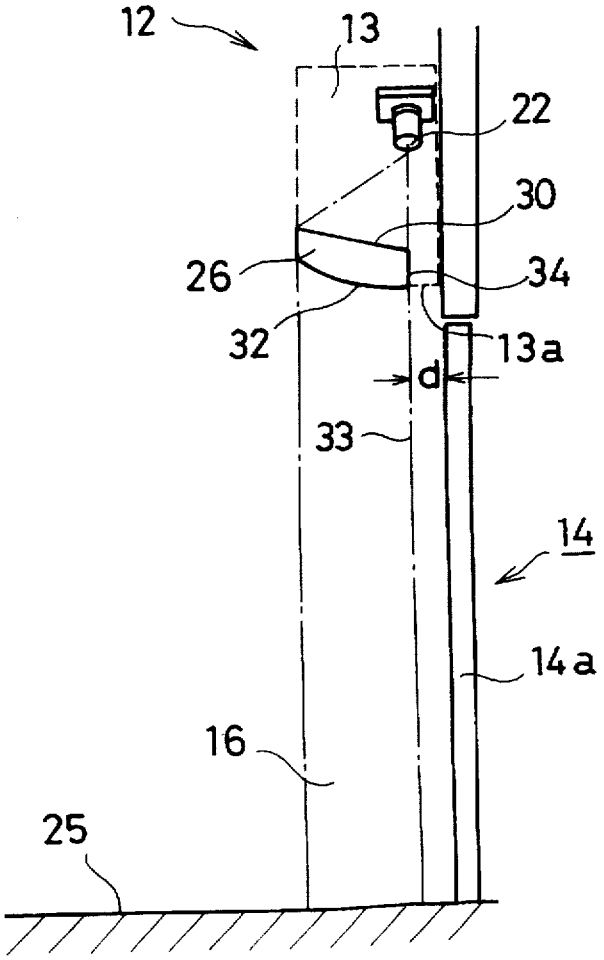
FIG. 2 is a schematic side elevational view of the door sensor system according to the first embodiment.

A door sensor system 12 is mounted above an automatic door 14 as shown in FIG. 2. The automatic door 14 includes two door panels 14*a* and 14*b* as shown in FIG. 1, which normally close a doorway. When the door sensor system 12 senses an object, such as a human, approaching the door, the door panels 14*a* and 14*b* move in the respective directions indicated by arrows in FIG. 1, to open the doorway. The door panels 14*a* and 14*b*, then, move in the opposite directions to close the doorway a predetermined time after the object has been sensed.

As shown in FIG. 1, the door sensor system 12 has a plurality of sensing areas, e.g. safety areas 16 on the floor near the automatic door 14 along the width of the door 14. The safety areas are such areas that as long as an object is in a safety areas, any of the door is kept open in order to prevent the object from being caught between door panels. Each safety area 16 overlaps adjacent safety areas. The safety areas 16 have a generally semi-circular shape swelling in the direction away from the door 14. The edge 16*a* of each safety area 16 on the door side is substantially straight or slightly swelling toward the door 14. Because of the edges 16*a* of the safety areas 16, regions 18 for which the sensor system 12 is ineffective, i.e. an object in which regions cannot be sensed by the sensor system 12, are reduced. Hereinafter, such regions are referred to as "ineffective regions". The ineffective regions 18 are between the edges 16*a* of the safety areas 16 and a region 20 which is not covered by the door sensor system 12. The uncovered region 20 is a region in which the door 14 lies and is provided to avoid the sensor system 12 from mistaking the door 14 for an object. Since the edges 16*a* of the respective safety areas 16 are substantially straight, the possibility that the sensor system 12 may erroneously sense the door panels 14*a* and 14*b* is reduced even if the safety areas 16 are disposed closer to the door 14 in order to reduce the ineffective regions 18. This enables the dimension d of the uncovered region 20 in the direction perpendicular to the door surface to be reduced.

Figure 3:
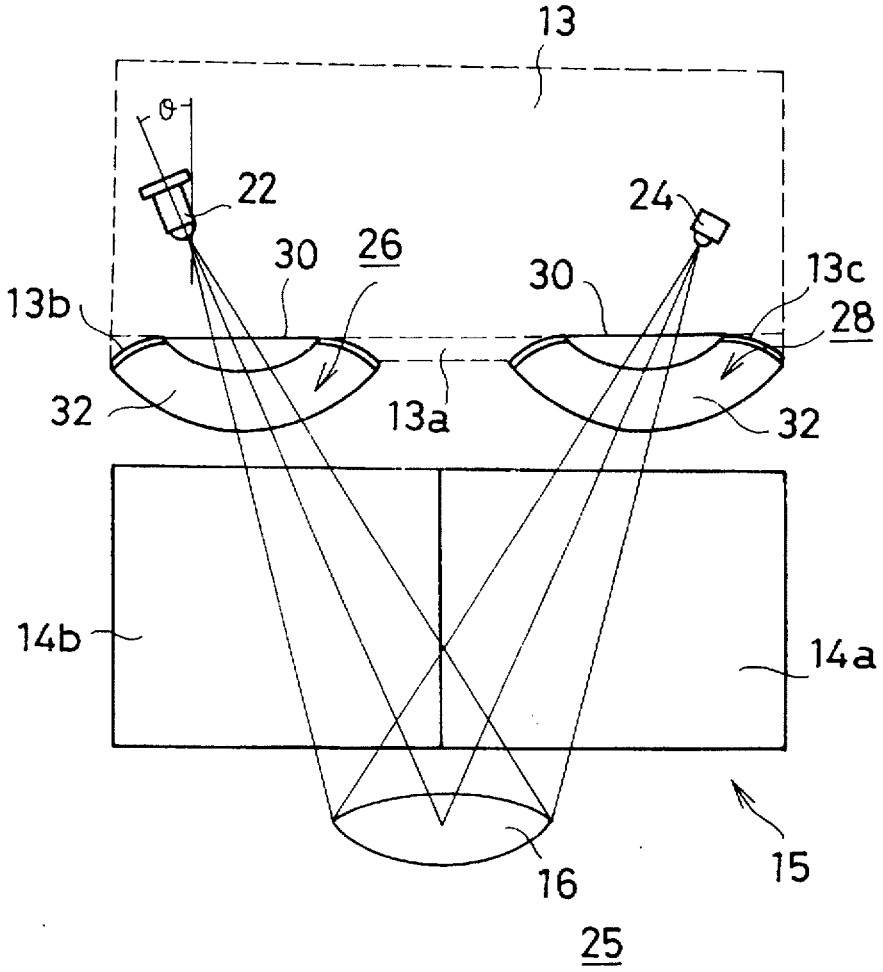
FIG. 3 is a front elevational view of the door sensor system according to the first embodiment.

To create the safety areas 16, the door sensor system 12 includes emitters 22 and receivers 24 disposed in a light-shielding casing 13 having a shape of rectangular parallelepiped, as shown in FIGS. 2 and 3. An infra-red light emitting diode may be used as the emitter 22, and an infra-red light receiving diode or an infra-red light receiving transistor may be used as the receiver 24. In FIG. 3, only one pair of emitter and receiver, 22 and 24, is shown for simplicity, but, in order to create a plurality of sensing areas or safety areas 16 as shown in FIG. 1, emitter-receiver pairs equal in number to the sensing areas must be arranged along the width of the door panels 14*a* and 14*b*.

For the purpose of simplicity, in the following description, only one emitter-receiver pair is discussed.

The emitter 22 is mounted toward a floor 25 at a predetermined angle θ with respect to a line perpendicular to the floor 25. A light ray emitted from the emitter 22 is condensed by condenser means, such as a plano-convex lens 26, through which light rays from all of the emitters 22 pass, and projected onto the floor 25 to thereby form a safety area 16. The angle θ is determined in accordance with the location of the safety area 16 to be formed. The plano-convex lens 26 is mounted in an opening 13*b* formed in the bottom wall 13*a* of the casing 13 facing the floor 25. The shape of the opening 13*b* is conformable with the shape of the lens 26.

If there is no object such as a human which blocks the light ray in the safety area 16, the light ray is reflected from the floor 25 in the safety area 16 and is condensed by another condenser means, such as a plano-convex lens 28. The condensed light ray impinges on the receiver 24. The receiver 24 is arranged to face the floor 25 at such an angle with respect to a line perpendicular to the floor 25 that it can properly receive light reflected from the floor 25 in the safety area 16. The plano-convex lens 28 is also mounted in an opening 13*c* in the bottom wall 13*a* of the casing 13, and reflected light from all of the sensing areas pass through the lens 28. The shape of the opening 13*c* is conformable with the shape of the lens 28.

FIG. 3 schematically shows how the safety area 16 is formed by light emitted from the emitter 22 and how light reflected from the floor 25 in the safety area 16 is received by the receiver 24.

The plano-convex lenses 26 and 28 have a semi-circular cross-section as shown in FIGS. 2 and 3. They have a planar surface 30 on the emitter side, and a convex surface 32 on the opposite side, facing the floor 25. The convex surface 32 is a spherical surface.

Between the convex surface 32 and the planar surface 30, each of the lens 26 and 28 has a flat end surface 34. The center axis on which the focal point and the center of the lens lying in the flat end surface 34. The end surfaces 34 of the plano-convex lenses 26 and 28 are disposed at a distance d from the panels 14*a* and 14*b* of the door 14, which is equal to the aforementioned dimension d of the uncovered region 20 of the system. The plano-convex lenses 26 and 28, the emitter 22 and the receiver 24 are positioned with respect to each other in such a manner that the optical axes of the emitter 22 and the receiver 24 pass through the respective centers of the lenses 26 and 28. The optical axis of a lens herein is an axis along which the maximum intensity is emitted or received. In place of the lenses 26 and 28 which have their center axes lie in the end surfaces 34 thereof, lenses with their center axes not lying in the end surfaces 34 may be used. In such a case, too, the emitter 22 and the receiver 24 are preferably disposed in such a manner that their optical axes lie in the end surfaces 34.

A light component 33 of a light ray emitted from the emitter 22 on the optical axis goes straightforward along the end surface 34 of the lens 26, arrives at the floor 25, and, then, is reflected from it. A light component emitted in the direction toward the door 14 is blocked by the portion of the wall 13*a* of the casing 13 lying between the opening 13*b* and the door 14 and, therefore, does not reach the floor 25. Thus, the light component 33 defines the edge 16*a* of the safety area 16. The edge 16*a* is slightly curved, since part of light components of the light ray emitted from the emitter 26 other than the component 33 reach the floor in the vicinity of the reaching point of the light component 33.

Light components passing through the peripheral edge surface of the lens 26 other than the end surface 34 advance in parallel with the center axis of the lens 26 and define the remaining edge of the safety area 16. Since the convex surface 32 is a semi-circular, the other edge of the safety area 16 is also semi-circular.

Reflected light from the safety area 16 is condensed by the lens 28 and is received by the receiver 24. In this case, too, since the lens 28 is configured as described above, only light which is reflected from the floor 25 within the safety area 25 is received.

Figure 4:
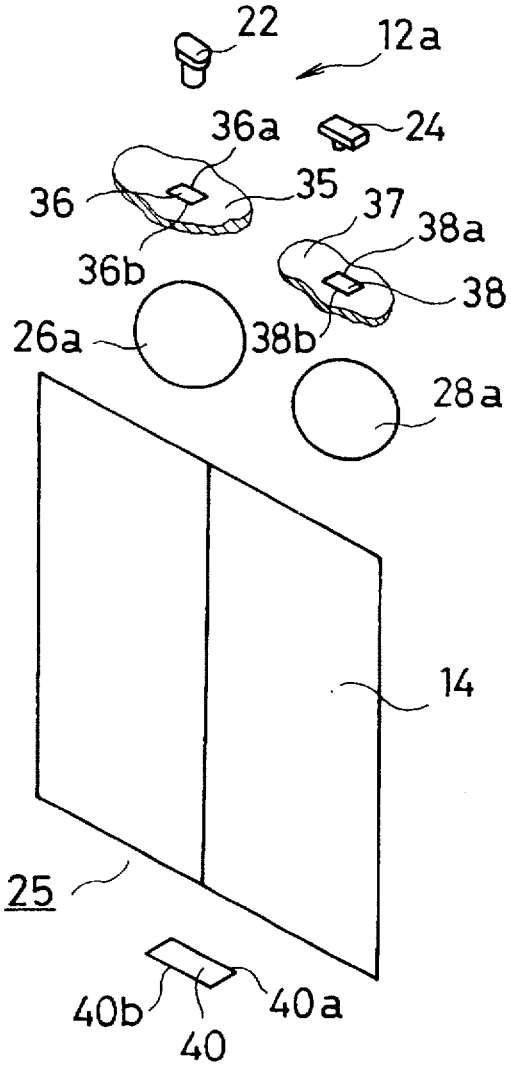
FIG. 4 is a perspective view of the door sensor system according to a second embodiment of the present invention.

A door sensor system 12*a* according to a second embodiment of the present invention is shown in FIG. 4. The same or similar elements of the first and second embodiments are given the same reference numerals. The door sensor system 12*a* includes emitters 22 and receivers 24 disposed in a casing (not shown), like the door sensor system 12. The door sensor system 12*a* also includes convexo-convex lenses 26*a* and 28*a* for each emitter-receiver pair as in the first embodiment. Shield plates 35 and 37 having rectangular slits 36 and 38 therein are disposed between the emitters 22 and the lens 26*a* and between the receivers 24 and the lens 28*a*, respectively. The slit 36 has a pair of edges 36*a* and 36*b* which are in parallel with a door 14, and the slit 38 has a pair of edges 38*a* and 38*b* which are in parallel with the door 14.

Only that portion of light emitted from the emitter 22 which passes through the slit 36 is condensed by the convexo-convex lens 26*a* and projected onto the floor 25 to produce a sensing area 40. Because the slit 36 is rectangular, the sensing area 40 has substantially straight edges 40*a* and 40*b* which are substantially in parallel with the door surface of the door 14. Light reflected from the sensing area 40 is condensed by the convexo-convex lens 28*a*, passes through the slit 38, and is received by the receiver 24. Since the shape of the sensing area 40 is defined by the slits 36 and 38, plano-convex or other convex lenses may be used instead.

In the second embodiment, too, for a plurality of sensing areas disposed along the width of the door, a plurality of emitter-receiver pairs and slits are used. Further, although the shield plates 35 and 37 are described to be disposed between the emitter 22 and the lens 26*a* and between the receiver 24 and the lens 28*a*, respectively, the lenses 26 and 28 may be disposed between the emitter 22 and the shield plate 35 and between the receiver 24 and the the shield plate 37, respectively.

In the first and second embodiments described above, the emitters 22 and the receivers 24 are used to determine the presence of an article by sensing whether light emitted from the emitter 22 is blocked by the object or not. Alternatively, an infra-red radiation receiver may be used, which receives a heat wave, such as an infra-red radiation, emanating from an object, such as a human. In such a case, the emitter 22 and the lens 26 are removed and a device which can detect infra-red radiation is used as the receiver 24, in the first embodiment. In the second embodiment, the emitter 22, the lens 26*a*, and the shield plate 35 are removed, and a device which can detect infra-red radiation is used as the receiver 24.

Figure 5:
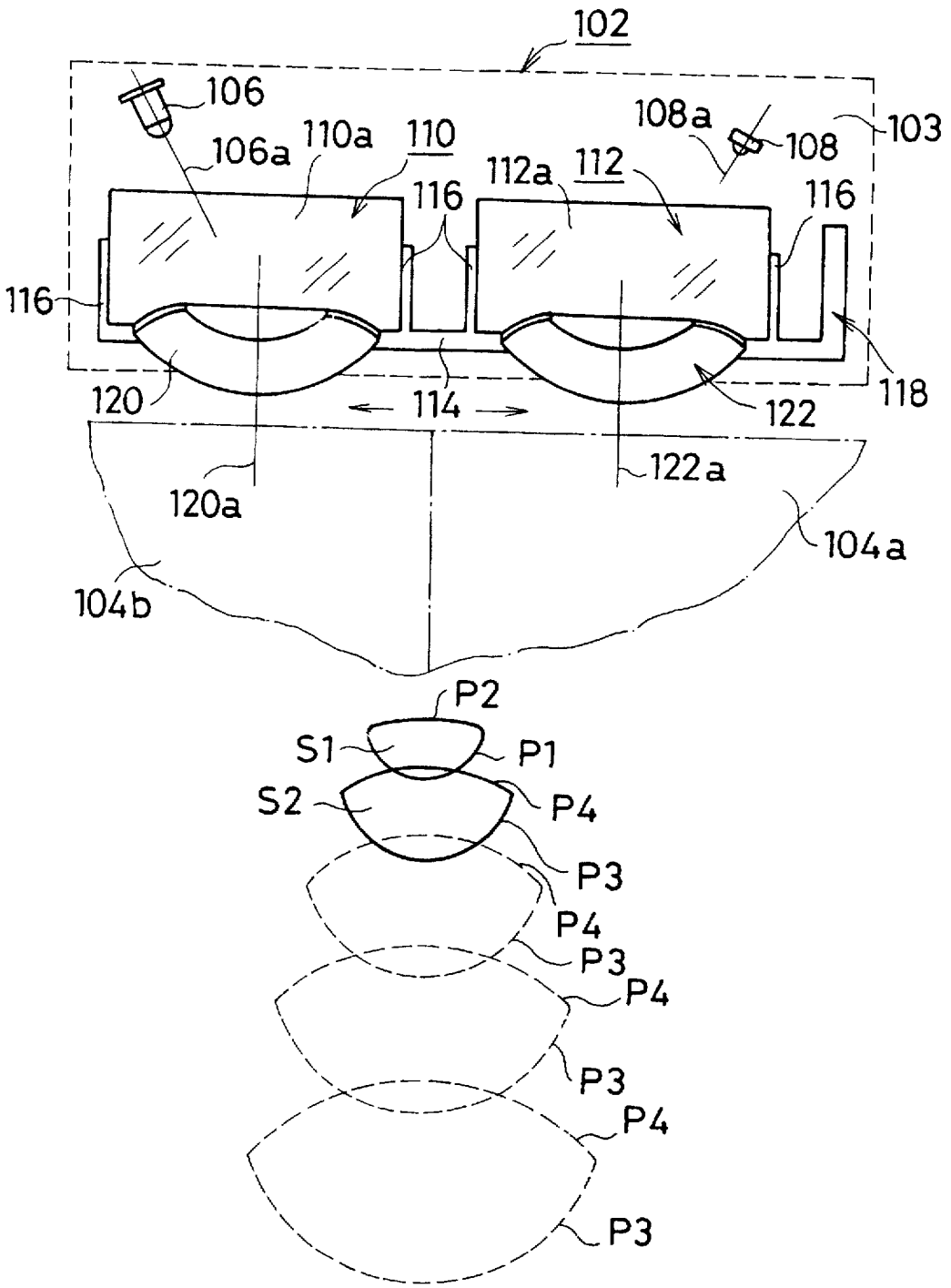
FIG. 5 is a front elevational view of the door sensor system according to a third embodiment of the present invention.

A door sensor system 102 according to a third embodiment is shown in FIGS. 5, 6*a*–6*d*, and 7*a*–7*d*. The sensor system 102 is also mounted above an automatic door 104 as shown in FIG. 5. The door 104 includes two door panels 104*a* and 104*b* indicated by phantom lines in FIG. 5. The door panels 104*a* and 104*b* are arranged to normally close a doorway, and are moved in the directions indicated by arrows to open the doorway when an object, such as a human, is detected by the door sensor system 102. The door panels 104*a* and 104*b* move in the opposite directions to close the doorway when a predetermined time period has lapsed since the sensor system 102 detected the object.

Figures 7A, 7B, 7C, 7D, 7E:
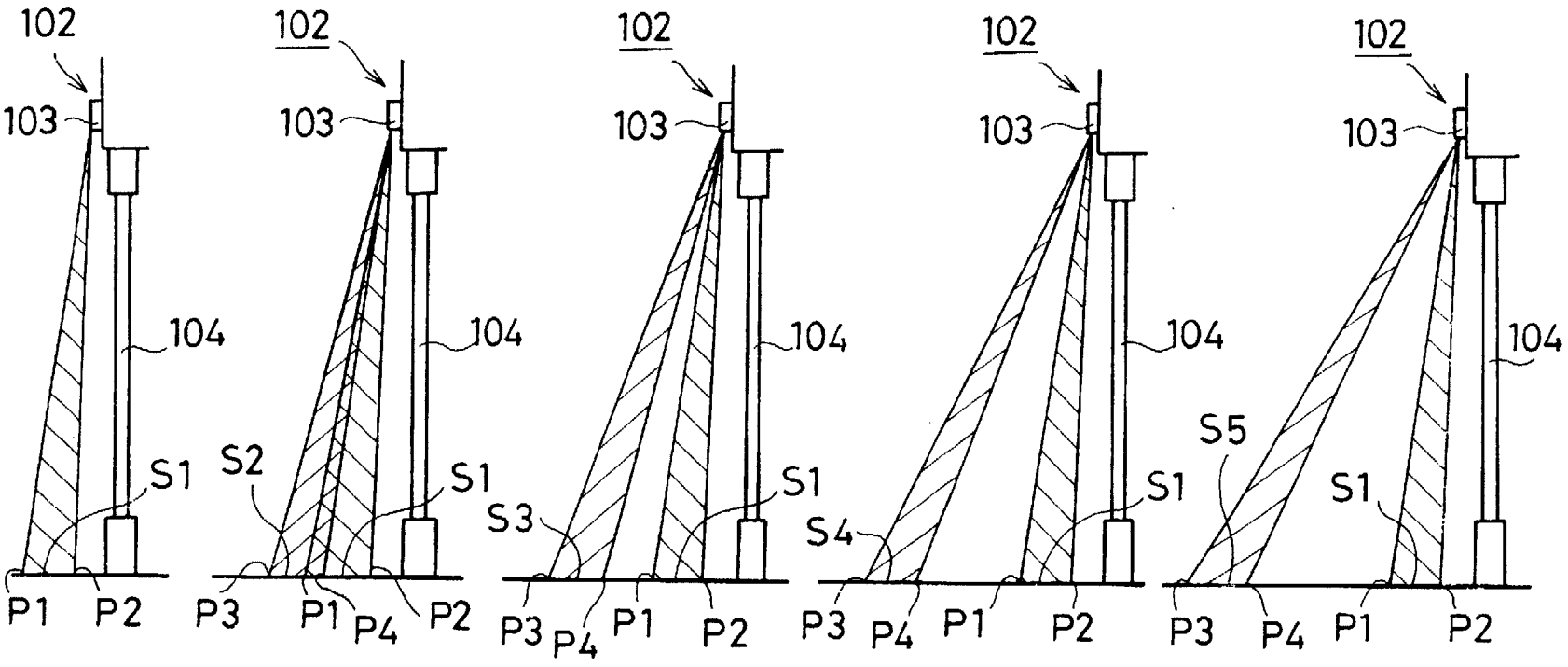
FIGS. 7*a* through 7*e* are side elevational views showing sensing areas formed at various locations in the door sensor system of the third embodiment.

As shown in FIG. 7*a*, a first area, e.g. a safety area S1 is established on the floor close to the door 104 and along the door panels 104*a* and 104*b*. Although only one safety area S1 is shown and described for simplicity, a plurality of such areas S1 are established along the door panels. As in the first and second embodiments, the safety area S1 only may be used in the third embodiment, but the door sensor system 102 is arranged such that in addition to the safety area S1, a second area, e.g. a sensing area S2, may be established on the floor at a location remoter from the door 104 than the safety area S1. The sensing area S2 is an area for sensing an object approaching to the door 104 to open the door 104.

As shown in FIG. 7*b*, the sensing area S2 may overlap the safety area S1. Alternatively, as shown in FIGS. 7*c*, 7*d*, or 7*e*, a sensing area S3, S4, or S5 which is at a different distance from the safety area S1 may be established together with the safety area S1. The safety area S1 is at a fixed location, but the sensing area S2, S3, S4, or S5 can be formed at any location at a desired distance from the door 104. That the location of the sensing area is variable is advantageous, because the door sensor system 102 can be adapted for different installation places, such as a place where the passage before the door is narrow, a place such as an entrance to a large office building where there is a wide space in front of the door.

In order to form the safety area S1 and the sensing area S2, S3, S4 or S5, the sensor system 102 includes, as shown in FIG. 5, light emitters 106, such as infra-red emitting diodes, and light receivers 108, such as photodiodes or phototransistors, are mounted in a light-shielding casing 103 indicated by a broken line. One emitter and one receiver operate in pair. The numbers of the emitters 106 and receivers 108 are the same as the number of the safety areas S1 and sensing areas S2, S3, S4 or S5, but only one emitter-receiver pair is shown and described. An emitter 106 and its associated receiver 108 are tilted toward the door panels 104*a* and 104*b* at angles with respect to a vertical plane which is perpendicular to the plane of the door panels 104*a* and 104*b*. The angles are determined depending on the location along the door 104 of the safety area S1 defined by that emitter-receiver pairs.

Figure 6A:
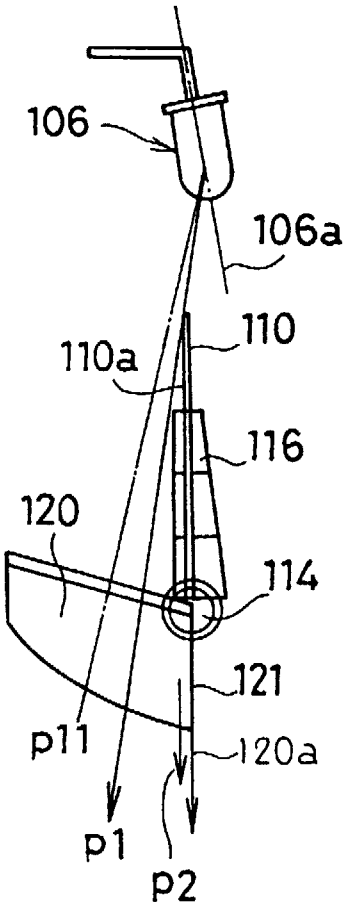
FIGS. 6*a* through 6*e* show how the location of a sensing area can be changed in the door sensor system of the third embodiment.

As shown in FIGS. 6*a* through 6*e*, the emitter 106 has its optical axis (the axis extending forward from the emitter along which the maximum amount of light is emitted) 106*a* slightly tilted toward the side of the vertical plane parallel to the door 104 opposite to the side where the safety area S1 is established. More specifically, the emitter 106 emits light diverging with a predetermined divergence angle about the optical axis 106*a*. The optical axis 106*a* is tilted toward the door panels 104*a* and 104*b* at such an angle that the light component remotest from the door 104 passes tangent to the upper edge of the reflector 110 when it is upright or parallel with the door panels 104*a* and 104*b* as shown in FIG. 6*a*.

The associated receiver 108 has its optical axis (the axis extending forward from the receiver along which the receiver receives the maximum amount of light) similarly tilted.

Below the emitter 106, disposed is splitter means, e.g. a planar reflector mirror 110. Below the receiver 108, limiting means, e.g. a planar reflector mirror 112 is disposed. The reflecting surfaces 110*a* and 112*a* of the reflectors 110 and 112 are arranged to face the floor where the safety area S1 and the sensing area are defined. The lower edges of the reflectors 110 and 112 are attached to shifter means, such as a tilting member 114. The tilting member 114 extends horizontally along the direction in which the door panels 104*a* and 104*b* move, as shown in FIG. 5, and is rotatable about the horizontally extending axis.

The reflectors 110 and 112 are supported by supports 116 extending along the respective sides of the reflectors 110 and 112 from the tilting member 114. The two reflectors 110 and 112 are attached to the tilting member 114 in such a manner as to lie in the same plane. Thus, the reflectors 110 and 112 are at the same angle with respect to a plane in parallel with the plane of the door panels 104*a* and 104*b*.

A lever 118 is fixed to one end of the tilting member 114 for tilting the member 114. By manipulating the lever 118, the angle of the both reflectors 110 and 112 relative to the plane which is parallel with the door panels 104*a* and 104*b* is varied. When the tilting member 114 is rotated to a desired position, a latch (not shown) provided on the tilting member 114 latches the member at that position. Alternatively, the reflectors 110 and 112 may be rotated by incremental angles and fixed at a desired angular location by an appropriate stop.

An emitter lens 120 is disposed adjacent to the tilting member 114, for condensing light impinging directly from the emitter 106 and light reflected from the reflector 110 and for directing condensed light toward the floor. Similarly, a receiver lens 122 is disposed adjacent to the tilting member 114, for condensing light reflected from the floor and directing part of condensed light directly to the receiver 108 and directing part of light to the reflector 112 for reflection to the receiver 108.

Plano-convex lenses as the ones used in the first and second embodiments may be used as the lenses 120 and 122. As shown in FIG. 5, a plane in which the optical axis 106*a* of the emitter 106 lies and which is perpendicular to the door 104 passes through the center of the emitter lens 120. As shown in FIG. 6*a*, the center axis 120*a* of the lens 120 which passes through the center of the lens 120 (which lies in the end surface 121 of the lens 120, as In the first and second embodiments) lies in a vertical plane which is perpendicular to the door panels 104*a* and 104*b*.

Similarly, as shown in FIG. 5, a plane in which the optical axis 108*a* of the receiver 108 lies and which is perpendicular to the door panels 104*a* and 104*b* passes through the center of the receiver lens 122, and the center axis 122*a* of the receiver lens 122 lies in a vertical plane which is perpendicular to the door panels 104*a* and 104*b*.

As in the first embodiment, the lenses 120 and 122 are mounted in the casing 103, and, no light is emitted or received from the periphery of the lenses.

It should be noted that all the emitter-receiver pairs in the casing 103 share the reflectors 110 and 112, the tilting member 114, and lenses 120 and 122.

As shown in FIGS. 7*a*–7*e*, the lever 118 is adjusted to change the angle of the reflectors 110 and 112 with respect to a vertical plane which is parallel to the door panels 104*a* and 104*b* so as to establish the safety area S1 only (FIG. 7*a*), the safety area S1 and the sensing area S2 (FIG. 7*b*), the safety area S1 and the sensing area S3 (FIG. 7*c*), the safety area S1 and the sensing area S4 (FIG. 7*d*), or the safety area S1 and the sensing area S5 (FIG. 7*e*).

In order to avoid complexity of the illustration, light emitted from the emitter 106 to establish the safety area S1 and the sensing area S2, S3, S4 or S5, and reflected light from the safety area S1 and the sensing area S2, S3, S4 or S5 are not shown.

FIGS. 6*a* through 6*e* illustrate how the respective areas are established. For simplifying the explanation, condensation of light by the emitter lens 120 and the receiver lens 122 is not considered.

As shown in FIG. 6*a*, when the reflectors 110 and 112 are at Angle 1, at which angle their reflection surfaces lie in a plane parallel to the door panels 104*a* and 104*b*, the outermost component p1 of light emitted from the emitter 106 advances straightforward, passing at the upper edge of the reflector 110, and is projected through the emitter lens 120 onto the floor to thereby define the outer edge P1 (FIG. 7*a* and FIG. 5) of the safety area S1.

Actually, the emitter 106 emits not only diverging light components, but also a component p2 which is in parallel with the door panels 104*a* and 104*b*. The component p2 defines the other outer edge P2 (FIG. 7*a* and FIG. 5). The safety area S1 is established by the light components p1 and p2 and components lying between these components p1 and p2. If the outermost light component of light from the emitter 106 is a component p11 indicated by a phantom line in FIG. 6*a*, which passes above the reflector 110, it defines the outer edge P1 of the safety area S1.

After the safety area S1 is established, if light reflected from the safety area S1 is not blocked by an object, reflected versions of the light components p1 and p2 pass through the receiver lens 122 and are received by the receiver 108. These components are not reflected by the reflector 112, but are directly incident on the receiver 108. More specifically, assuming that the emitter 106 and the condenser lens 120 shown in FIG. 6*a* are the receiver 108 and the condenser lens 122, the reflected light components lying between p1 and p2 inclusive propagate along the paths in the directions opposite to the directions indicated by arrows in FIG. 6*a* and are received by the receiver 108. Other light components are reflected away by the reflector 112 and do not impinge on the receiver 108.

Figure 6B:
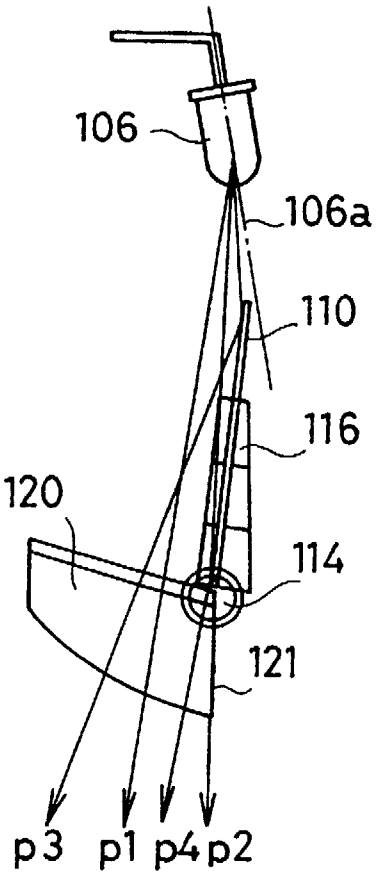

When the reflectors 110 and 112 are rotated clockwise to a position in which the reflector surfaces are at a predetermined angle (Angle 2) with respect to the door panels 104*a* and 104*b*, as shown in FIG. 6*b*, light components p1 and p2 define the outer edges P1 and P2 (FIG. 7*b* and FIG. 5) of the safety area S1, as in the case shown in FIG. 6*a*.

In addition, a light component p3 reflected from the upper edge of the reflector 110 defines an outer edge P3 of the sensing area S2, and a light component p4 reflected from the lower edge of the reflector 110 defines the other outer edge P4 of the sensing area S2 (FIG. 7*a* and FIG. 5). As is understood from FIG. 6*b*, since the light components p4 and p1 cross each other, the safety area S1 and the sensing area P4 overlap with each other. Like this, in addition to the safety area S1, the sensing area S2 is also established.

Light components reflected from the safety area S1 and the sensing area S2 follow paths in the opposite directions to the emitted light components shown in FIG. 6*b*, with the receiver 108, the lens 122 and the reflector 112 substituted for the emitter 106, the lens 120 and the reflector 110 in FIG. 6*b*, and impinge onto the receiver 108. Other light components are reflected away by the reflector 112 and, therefore, do not impinge onto the receiver 108.

Like this, the reflector 112 limits reflected light components which are received by the receiver 108.

The light receiving process is the same as the described above for the following Angle 3, Angle 4, and Angle 5 cases, and, therefore, no more explanation is made for the light receiving process.

Figure 6C:
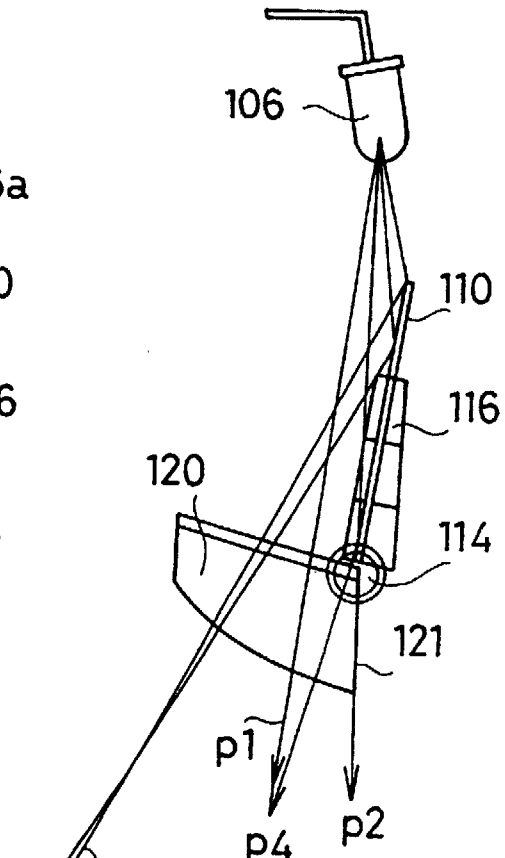

When the reflectors 110 and 112 are further rotated clockwise than the case of Angle 2 so that the reflector surfaces are at a larger Angle 3 with respect to the door panels 104*a* and 104*b*, as shown in FIG. 6*c*, the edges P1 and P2 of the safety area S1 (FIG. 7*c* and FIG. 5) are defined in the same manner as in FIG. 6*b*. In other words, the safety area S1 remains at the same location as in in the cases of Angle 1 (FIG. 6*a*) and Angle 2 (FIG. 6*b*). The safety area S1 remains at the same location in the later-mentioned cases of Angle 4 and Angle 5.

A light component p3 reflected from a portion near the upper edge of the reflector 110 is projected through the lens 120 onto the floor to define an edge P3 of the sensing area S3. A light component p31 which is reflected from the upper edge of the reflector 110 is incident on the floor at a location closer to the door 104 than the component p3. A light component p4 reflected from the lower edge of the reflector 110 is projected through the emitter lens 120 onto the floor and defines an edge P4 of the sensing area S3.

The angles of the components p3 and p4 with respect to a vertical plane which is in parallel with the door panels 104*a* and 104*b* are larger in the Angle 3 case (FIG. 6*c*) than in the Angle 2 case (FIG. 6*b*), and, therefore, the the sensing area S3 is established at a location further from the door 104 than the location in the Angle 2 case.

Figure 6E:
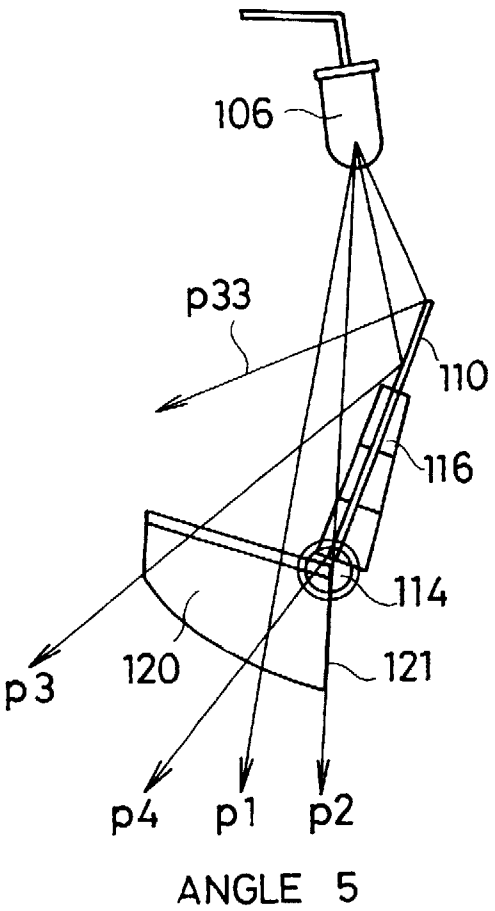
Figure 6D:
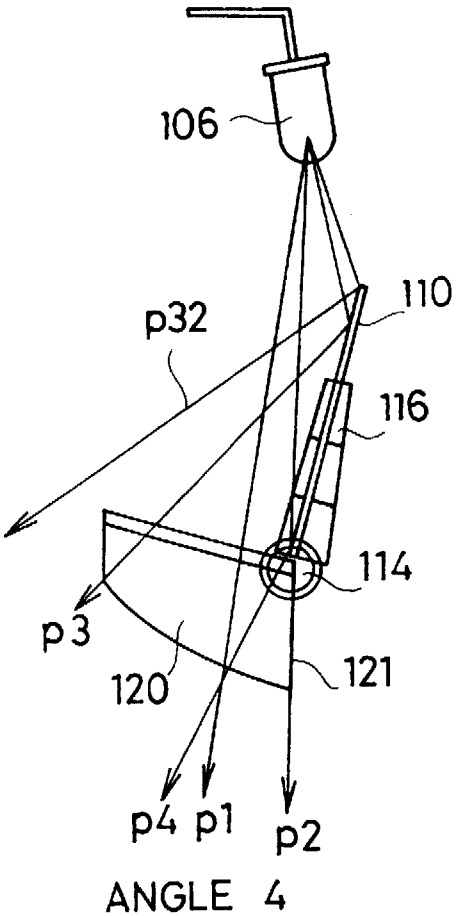

When the reflectors 110 and 112 are rotated further clockwise than the Angle 3 case so that the reflector surfaces are at a larger Angle 4 with respect to the vertical plane parallel to the door panels 104*a* and 104*b*, as shown in FIG. 6*d*, the edges P1 and P2 of the safety area S1 are defined at the same locations as in the Angle 2 and Angle 3 cases.

A light component p3 reflected from a portion near the upper edge of the reflector 110 is projected through the outermost periphery of the emitter lens 120 onto the floor to define an outer edge P3 of the sensing area S4 (FIG. 5 and FIG. 7*d*). A light component impinging onto the upper edge of the reflector 110 is reflected, as a component p32, away from the outermost periphery of the lens 120 and is absorbed by the casing 103, and, therefore, it does not contribute to the defining of the sensing area S4. A light component p4 reflected from the lower edge of the reflector 110 is projected through the lens 120 onto the floor and defines the other edge P4 of the sensing area S4.

In comparison with the light components p3 and p4 shown in FIG. 6*c*, the angles of the light components p3 and p4 with respect to the vertical plane which is in parallel with the door panels 104*a* and 104*b* shown in FIG. 6*d* are larger, and, therefore, the location of the sensing area S4 is further away from the door 104 than the sensing area S3, as is seen from FIGS. 7*c* and 7*d*.

As shown in FIG. 6*e*, when the reflectors 110 and 112 are further rotated clockwise than the Angle 4 case shown in FIG. 6*d* so that the reflector surfaces are at a larger angle (Angle 5) with respect to the vertical plane parallel with the door panels 104*a* and 104*b*, the edges P1 and P2 (FIG. 5 and FIG. 7*e*) are defined in the same way as in the cases of Angles 2, 3, and 4.

A light component p3 reflected from a portion near the upper edge of the reflector 110 is projected through the lens 120 onto the floor to define an edge P3 of the sensing area 5. A light component impinging on the upper edge of the reflector 110 is reflected as a light component p33 away from the outer edge of the lens 120 and, therefore, it is absorbed by the casing 103 and does not contribute to the defining of the sensing area S5. The other edge P4 of the sensing area S5 is defined in a similar manner to the Angle 2, Angle 3, and Angle 4 cases.

In comparison with the light components p3 and p4 in FIG. 6*d*, the angles of the components p3 and p4 with respect to the vertical plane parallel to the door 104 are larger, and, therefore, the sensing area S5 is established further away from the door 104 than the sensing area S4, as is understood from FIGS. 7*d* and 7*e*.

As described above, since the light components which define the safety area S1 are those which are not reflected by the reflector 110, but advance straightforward, the location of the safety area S1 does not change even if the tilting member 114 is rotated. On the other hand, because the sensing area is defined by light components reflected from the reflector 110, the sensing area can be shifted to any desired location, as exemplified by the sensing area S2, S3, S4, or S5, by adjusting the lever 118 of the tilting member 114.

In the described embodiment, the optical axes 106*a* and 108*a* of the emitter 106 and the receiver 108 are tilted with respect to a vertical plane which is in parallel with the door panels 106*a* and 106*b*, but such tilting does not contribute to the formation of the fixed safety area S1 and the shiftable sensing area. The fixed safety area S1 and the shiftable sensing area can be also formed with the optical axes of the emitter 106 and the receiver 108 aligned with the vertical plane.

The reason why the optical axes of the emitter 106 and the receiver 108 are tilted is as follows. The intensity of light emitted from the emitter 106 is the largest in the vicinity of the optical axis 106*a*, and gradually decreases with the distance from the optical axis 106*a*. If the emitter 106 emits light with the same intensity, the amount of light received by the receiver 108 is smaller as the distance of the receiver 108 from the emitter 106 is larger.

In the above-described third embodiment, the optical path of light reflected from the sensing area S2, S3, S4 or S5 and received by the receiver 108 is longer than the optical path of light reflected from the safety area S1 and received by the receiver 108. Furthermore, as described above, the safety area S1 is illuminated with light coming directly from the emitter 106 which has not been reflected by the reflector 110, but the sensing area S2, S3, S4 or S5 is illuminated with light reflected from the reflector 110. Taking these facts into account, the optical axis 106*a* is tilted so that the intensity of light which follows the longer optical path toward the sensing area S2, S3, S4 or S5 is larger than that of light following the shorter optical path toward the safety area S1, whereby the equal amounts of light are received by the receiver 108.

In the illustrated example, the tilt angle is adjusted in such a manner that the sensitivity to the safety area S1 and the sensitivity to the sensing area S4 in the Angle 4 case shown in FIGS. 6*d* and 7*d* are equal.

A fourth embodiment of the present invention is shown in FIGS. 8, 9*a*–9*e*, and 10*a*–10*e*.

A door sensor system 102*a* of this embodiment has a fixed safety area S1 and a fixed sensing area S2 adjacent to the safety area S1, and also a shiftable sensing area S3, S4 or S5, as shown in FIGS. 10*a* through 10*e*. The use of a plurality of sensing areas can provide a larger zone for detecting an object, and also a more reliable detection.

Figure 8:
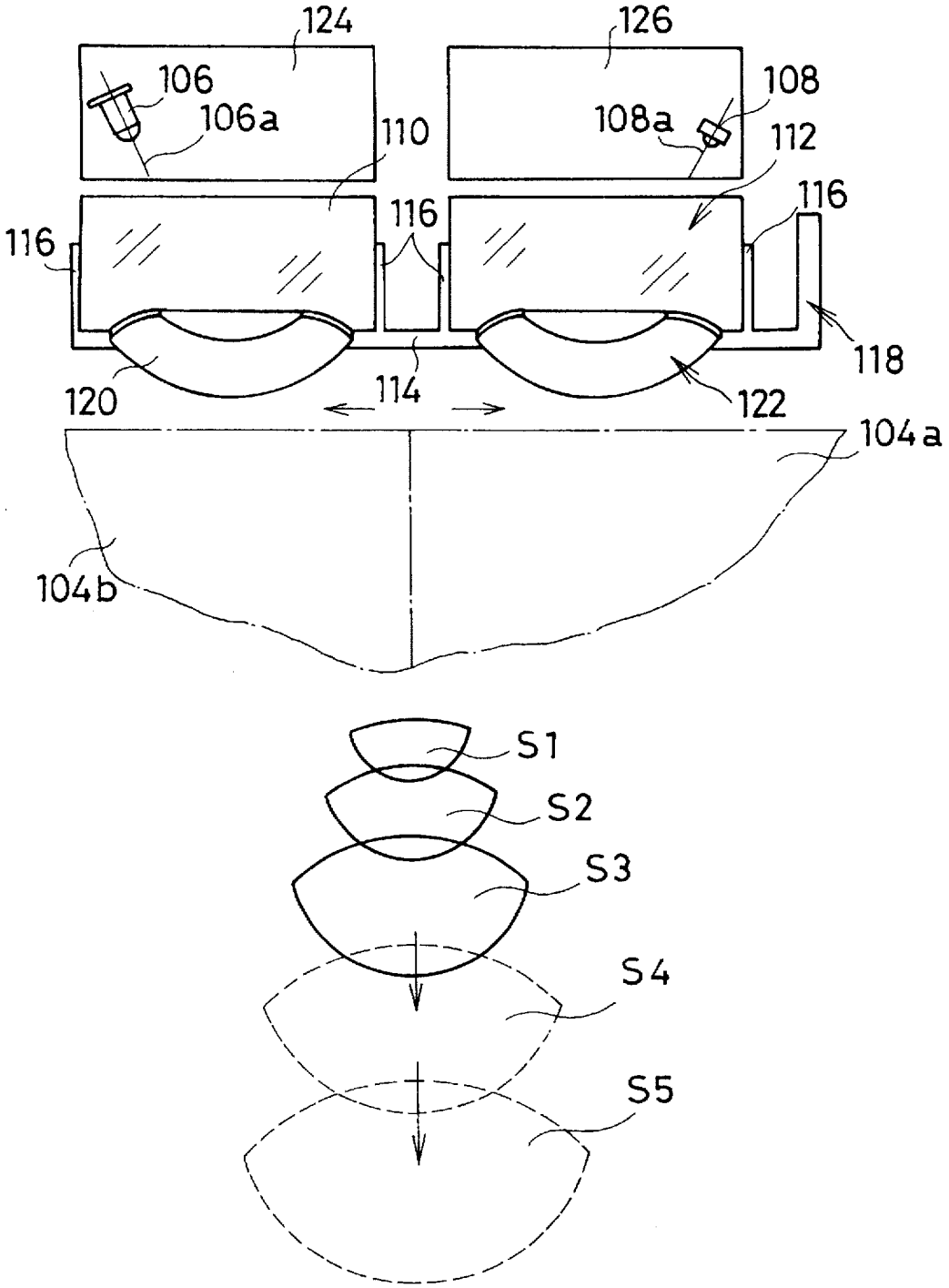
FIG. 8 is a schematic front elevational view of a door sensor system according to a fourth embodiment.

For this purpose, according to the fourth embodiment, in addition to the emitters 106, the receivers 108, the reflectors 110 and 112, the tilting member 114, the emitter lens 120, and the receiver lens 122 as used in the third embodiment, another light splitter means and limiting means, such as a planar reflectors 124 and 126 are used, as shown in FIG. 8. The reflectors 110 and 112 are adjustable by means of the tilting member 114, while the reflectors 124 and 126 are fixed.

The reflector 124 is disposed above the reflector 110 substantially in contact with the emitter 106 on the door side, with the reflecting surface of the reflector 124 being in parallel with the door 104 and facing away from the door 104. Different from the third embodiment, the emitter 106 has its optical axis 106*a* tilted toward the door 104 such an angle that that component of the divergent light emitted from the emitter 106 which falls at the center of the safety area S1 passes tangent to the upper edge of the reflector 110 when it is in the position parallel to the door 104 shown in FIG. 9*a*.

Similarly, the reflector 126 is disposed above the reflector 112 substantially in contact with the receiver 108 on the door side, with the reflecting surface of the reflector 126 being in parallel with the door 104 and facing away from the door 104. The receiver 108 also has its optical axis 108*a* tilted corresponding to the emitter 106.

Referring to FIGS. 9*a*–9*e* and 10*a*–10*e*, it is described how the fixed safety area S1 and the fixed sensing area S2 can be established, with other sensing area movable.

In order to avoid complexity of illustrations which could be caused by showing all the light components defining edges of the safety area S1 and edges of the sensing area S2 and another sensing area S3, S4 or S5, only the light component S1C falling at the center of the safety area S1, the light component S2C falling at the center of the fixed sensing area S2, the light component S3C falling at the center of the sensing area S3, the light component S4C falling at the center of the sensing area S4, and the light component S5C falling at the center of the sensing area S5 are shown in FIGS. 9*a*–9*e*. Further, as in the description about the third embodiment, the action of the condenser lenses 120 and 122 is not considered in the following discussion for the simplicity purpose.

Figure 9A:
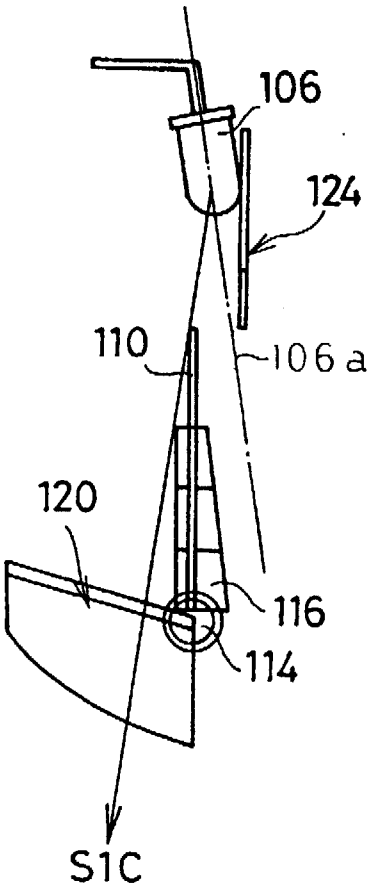
FIGS. 9*a* through 9*e* show how the location of a sensing area can be changed in the door sensor system of the fourth embodiment.

In a case where the reflector surfaces of the reflectors 110 and 112 are in a vertical plane parallel with the door panels 104*a* and 104*b* (Angle 1) shown in FIG. 9*a*, the light component S1C goes straight near the upper edge of the reflector 110, and is projected through the lens 120 onto the floor to define the safety area S1. The light component corresponding to the component S1C of light reflected from the safety area S1 goes to the lens 122 and passes near the upper edge of the reflector 112 to impinge on the receiver 108. Light components other than those which define the safety area S1 are reflected by the reflector 110 or 112 and, therefore, do not impinge on the receiver 108.

Figures 10A, 10B, 10C, 10D, 10E:
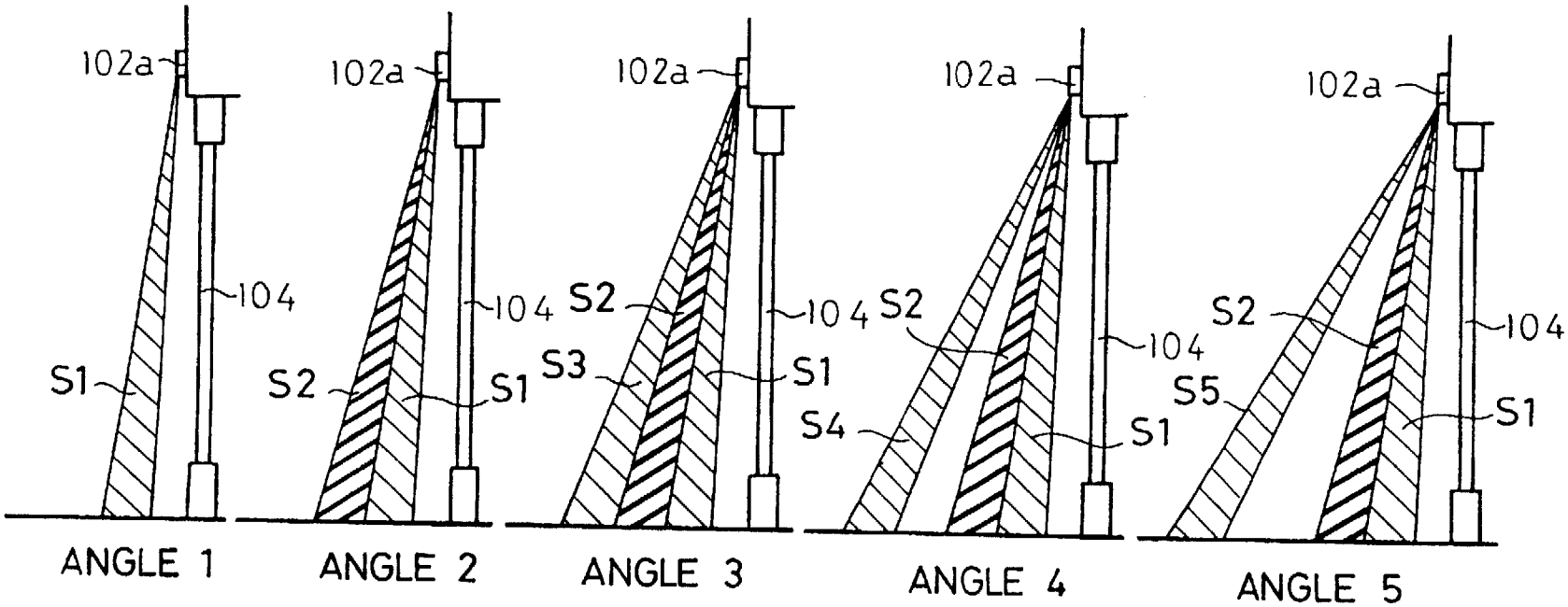
FIGS. 10*a* through 10*e* are side elevational views showing sensing areas formed at various locations in the door sensor system of the fourth embodiment.

Since light components which otherwise would define the sensing area S2 and other sensing area go behind the reflector 110 in FIG. 9*a*, they go straightforward behind the reflector 110 or are reflected by the fixed reflector 124 and then by the back of the reflector 110 and, therefore, absorbed by casing 103. Accordingly, they do not contribute to the formation of any sensing areas. Accordingly, when the reflectors 110 and 112 are upright, only the safety area S1 is established as shown in FIG. 10*a*.

Figure 9B:
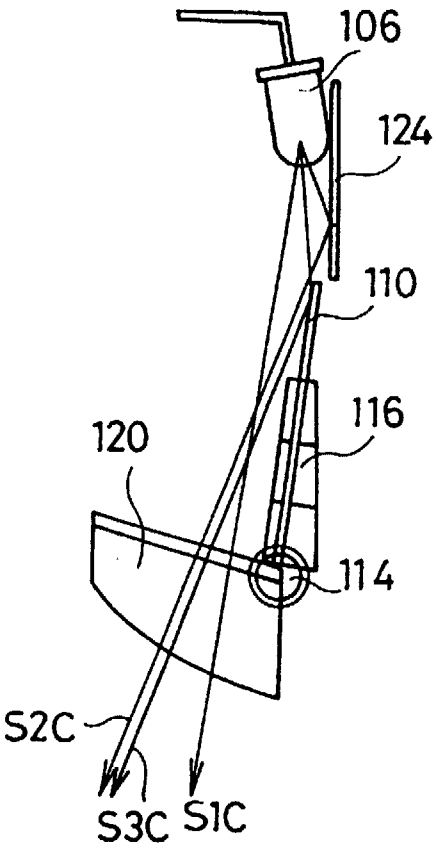

When the reflector 110 and 112 is rotated slightly clockwise from the position of Angle 1 to the position Angle 2 shown in FIG. 9*b*, the light component S1C advances straightforward to impinge on the floor to thereby establish the safety area S1. The light component S2C is reflected by the fixed reflector 124 to pass through the lens 120 and impinges on the floor. The light component S3C is reflected by a portion of the reflector 110 near its upper edge, and impinges on the floor through the lens 120. The light component S3C is very close to and substantially in parallel with the light component S2C. Thus, the light components S2C and S3C define the sensing area S2 as shown in FIG. 10*b*. The angles of the components S2C and S3C with respect to a vertical plane parallel with the door panels 104*a* and 104*b* are larger than the angle of the light component S1, and therefore, the sensing area S2 is defined at a location remoter from the door panels 104*a* and 104*b* than the safety area S1.

The light component reflected from the sensing area S1 corresponding to the light component S1C advances straight through the lens 122 to the receiver 108, and the light component reflected from the sensing area S2 corresponding to the component S2C is reflected by the upper edge of the reflector 112 and impinges on the receiver 108. The light component reflected from the sensing area S3 corresponding to the light component S3C is reflected by the reflector 126 and impinges on the receiver 108. Other light components reflected from other portions of the floor are reflected away by the reflector 112 or 126 and, therefore, do not impinge on the receiver 108.

As for the light receiving process, it is similar to the above-described in all of the following Angle 3, Angle 4, and Angle 5 cases, and, therefore, it is not described further.

Figure 9C:
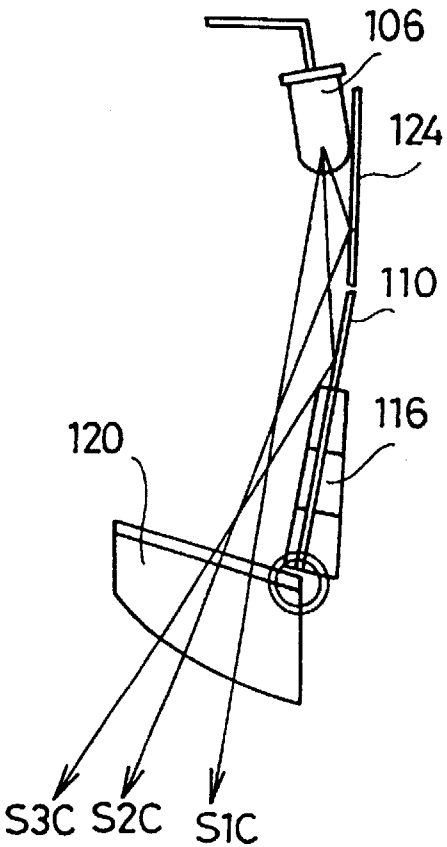

When the reflectors 110 and 112 are further rotated clockwise to Angle 3 from the Angle 2 position, shown in FIG. 9*c*, the safety area S1 and the sensing area S2 (FIG. 10*c*) are established by the light components S1C and S2C in a manner similar to the one described with respect to the Angle 2 case shown in FIG. 9*b*. These components S1C and S2C are not reflected by the reflector 110, and, therefore, their locations remain same as in the Angle 2 case shown in FIGS. 9*b* and 10*b*. (The locations of the safety area S1 and the sensing area S2 remain same in cases (Angle 4 and Angle 5) described later, too.)

The light component S3C is reflected by a portion of the reflector 110 slightly lower than its upper edge and is projected through the lens 120 onto the floor. Because the angle of the component S3C with respect to a vertical plane parallel with the door panels 104*a* and 104*b* is larger than the angle of the light component S2C, the sensing area S3 is defined at a location remoter from the door 104 than the sensing area S2, as shown in FIG. 10*c*.

Figure 9E:
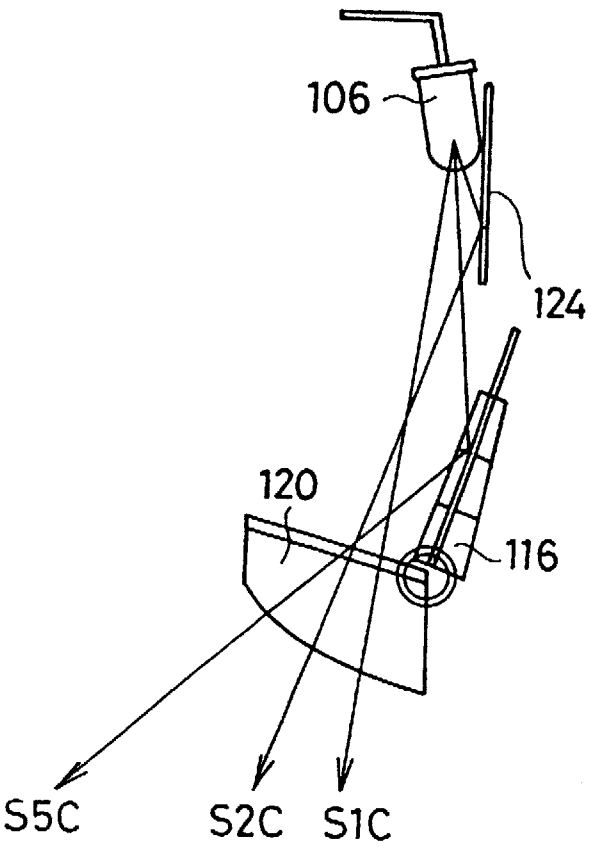
Figure 9D:
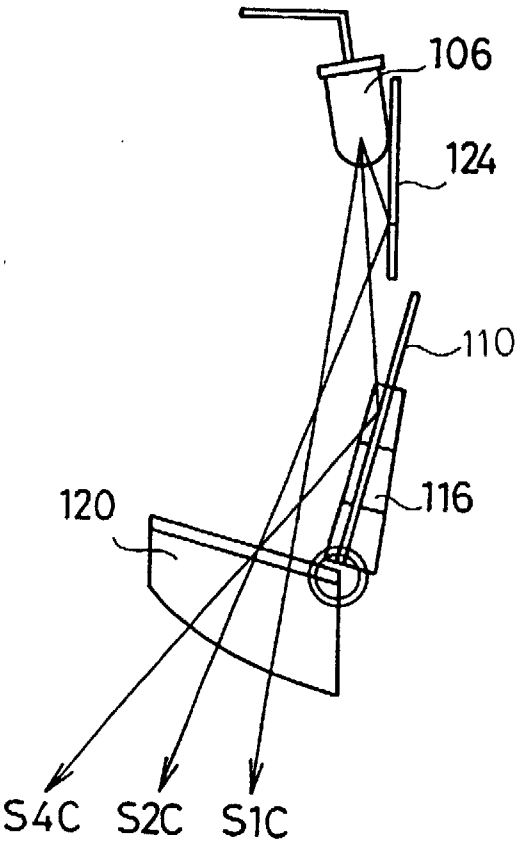

When the reflectors 110 and 112 are in the position rotated further clockwise to a position shown in FIG. 9*d* (Angle 4), the safety area S1 and the sensing area S2 are defined in a manner similar to the Angle 3 case. The light component S4C is reflected from a portion of the reflector 110 lower than its upper edge (which is far lower than the portion from which the light component S3C is reflected in the Angle 3 case), and projected through the lens 120 onto the floor. The angle of the light component S4C with respect to a vertical plane parallel with the door panels 104*a* and 104*b* is larger than the angle of the light component S3C, and, therefore, the sensing area S4 is defined at a location remoter from the door 104 than the sensing area S3, as shown in FIG. 10*d*.

When the reflectors 110 and 112 are in the Angle 5 position shown in FIG. 9*e*, which is rotated further from the Angle 4 position shown in FIG. 9*d*, the safety area S1 and the sensing area S2 are established in a manner similar to the case of the Angle 4 position. The light component S5C is reflected from a substantially central portion of the reflector 110, which is far lower than the portion from which the light component S4C is reflected in the Angle 4 position, and is projected through the lens 120 onto the floor. Because the angle formed between the light component S5C and a vertical plane parallel with the door panels 104*a* and 104*b* is larger than the angle between S4C and the same vertical plane, the sensing area S5 is defined at a location remoter from the door 104 than the location of the sensing area S4, as is understood from FIGS. 10*d* and 10*e*.

The reason why the optical axes of the emitters 106 and receivers 108 are tilted toward the fixed reflectors 124 and 126 is the same as described with respect to the third embodiment. If different sensitivities for different sensing areas are accommodated, the optical axes of the emitters 106 and receivers 108 may be directed vertical.

Figure 11:
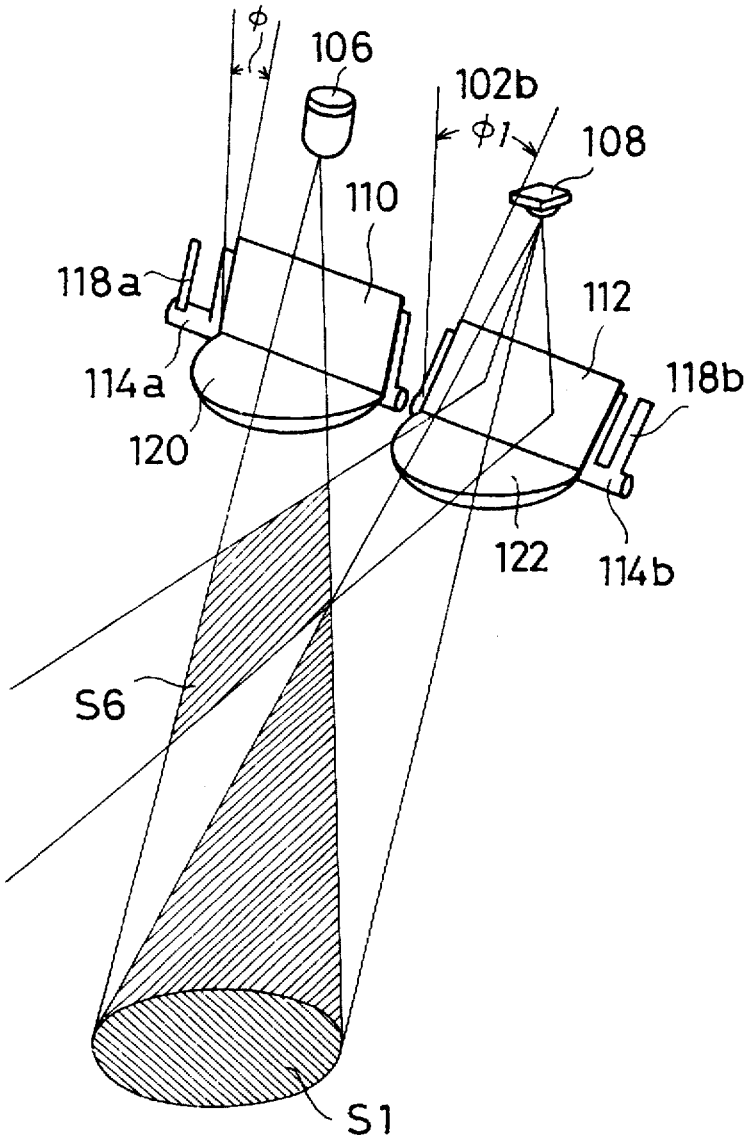
FIG. 11 is a schematic perspective view of a door sensor system according to a fifth embodiment of the present invention.

FIG. 11 shows a door sensor system 102*b* according to a fifth embodiment of the present invention. In the door sensor system of the fourth embodiment, the reflectors 110 and 112 are mounted on the single tilting member 114 in such a manner as to form the same angle with a vertical plane, while, according to the fifth embodiment, separate tilting members 114*a* and 114*b* are used for the reflectors 110 and 112, respectively. The tilting members 114*a* and 114*b* are independently manipulated.

With this arrangement, the safety area S1 can be established by light components which are not reflected by the reflectors 110 and 112, and, therefore, it can be located on the floor close to the door 104 as in the first embodiment. Using the angle θ between the reflector 110 and the vertical plane, which is different from the θ1 at which the reflector 112 is tilted with respect to the vertical plane, the optical path which is followed by the light emitted from the emitter 106, reflected by the reflector 110 and projected through the lens 120 to the floor and the optical path followed by the light passing through the lens 122 and reflected by the reflector 112 to impinge on the receiver 108 cross in the space above the floor, as shown in FIG. 11, whereby a sensing area S6 is defined at a location farther from the door 104 than the safety area S1 and above the floor.

The third, fourth and fifth embodiments have been described by means of the door sensor systems which use the light emitters 106 which emit infra-red light and the light receivers 108, and which determine the presence of an object, such as a human, by sensing whether the emitted infra-red light is blocked by the object or not. However, the present invention can be modified to use infra-red radiation detectors for detecting a heat wave, such as infra-red radiation, radiated by an object, e.g. a human, may be used. When such modification is made to the third embodiment, the emitters 106, the reflector 110 and the emitter lens 120 are eliminated and an infra-red detector is used in place of the receivers 108, and when such modification is to be made to the fourth embodiment, in addition to the emitters 106, the reflector 110 and the emitter lens 120, the reflector 124 can be eliminated, and an infra-red detector is used in place of the receivers 108.

In the fourth embodiment, the reflectors 124 and 126 are fixed, but they may be rotated in a manner similar to the reflectors 110 and 112. Further, in the fourth embodiment, more than two reflectors may be used for each of the emitters 106 and receivers 108. In such a case, all of the reflectors may be rotatable or at least one of them may be fixed. The tilting members 114, 114*a* and 114*b* are described to be connected to the lower edges of the reflectors 110 and 112, but they may be coupled to the mid portions or to the upper edges of the reflectors 110 and 112.

Although the present invention has been described by means of embodiments in which a plurality of emitters and receivers, or infra-red detectors, are used, but the number may be determined depending on the size of the door. Therefore, depending on the case, one emitter and one receiver, or one infra-red detector may be used.

Furthermore, the door sensor system can be mounted on the door itself instead of a building portion near the door.

What is claimed is:

1. A door sensor system comprising:

light-emitting means for generating light to be projected toward a floor near a door;

focusing means for focusing a component of light generated by said light-emitting means which impinges directly thereon and directing the focused light component directly toward a first region at a location along said door;

variably tiltable reflecting means for reflecting, toward said focusing means, a component of said light which does not directly impinge on said focusing means, and directing said reflected light component toward a second region at a location more remote from said door than said first region; and light-receiving means adapted to receive light reflected from said first and second regions.

2. The door sensor system according to claim 1, further comprising fixed reflecting means for reflecting part of said component of light which does not directly impinge on said focusing means toward said focusing means, and directing the reflected part toward a third region at a location along said first region.

3. The door sensor system according to claim 2 wherein the optical axis of said light-emitting means is so positioned that substantially equal amounts of light impinge on said variably tiltable reflecting means and said fixed reflecting means.

4. The door sensor system according to claim 1 wherein said focusing means is a plan-convex lens having its convex surface facing said floor, said lens having a straight edge facing said door, said straight edge being generally parallel to said door.

5. The door sensor system according to claim 4 wherein said light-emitting means is located above said straight edge of said plano-convex lens.

6. A door sensor system comprising:

light-emitting means for generating light to be projected toward a floor near a door;

light-receiving means adapted to receive light reflected from said floor;

focusing means for focusing a light component reflected from a first region on said floor at a location along said door and causing the focused light component to impinge directly on said light-receiving means; and variably tiltable reflecting means for reflecting a light component reflected from a second region at a location more remote from said floor than said first region and focused by said focusing means, to thereby cause the reflected and focused light component to impinge on said light-receiving means.

7. The door sensor system according to claim 6, further comprising fixed reflecting means for reflecting a light component reflected from a third region at a location along said first region and focused by said focusing means, to thereby cause the reflected and focused light component to impinge on said light-receiving means.

8. The door sensor system according to claim 7 wherein the optical axis of said light-receiving means is so positioned that said light-receiving means receives substantially equal amounts of light from said variably tiltable reflecting means and said fixed reflecting means.

9. The door sensor system according to claim 6 wherein said focusing means is a plano-convex lens having its convex surface facing said floor, said lens having a straight edge facing said door, said straight edge being generally parallel to said door.

10. The door sensor system according to claim 9 wherein said light-receiving means is located above said straight edge of said plano-convex lens.

11. A door sensor system comprising:

light-emitting means for generating light to be projected toward a floor near a door;

first focusing means for focusing a component of light generated by said light-emitting means which impinges directly thereon and directing the focused light component directly toward a first region at a location along said door;

first variably tiltable reflecting means for reflecting, toward said first focusing means, a component of said light which does not directly impinge on said first focusing means, and directing said reflected light component toward a second region at a location more remote from said door than said first region;

light-receiving means adapted to receive light reflected from said first and second regions;

second focusing means for focusing a light component reflected from said first region and causing the focused light component to impinge directly on said light-receiving means; and second variably tiltable reflecting means for reflecting a light component reflected from said second region and focused by said second focusing means, to thereby cause the reflected and focused light component to impinge on said light-receiving means.

12. The door sensor system according to claim 11 wherein said first and second variably tiltable reflecting means are at the same angle with respect to said door and are tilted together to a same angular position.

13. The door sensor system according to claim 11 wherein said first and second variably tiltable reflecting means are operated independent of each other.

14. The door sensor system according to claim 11 further comprising:

first fixed reflecting means for reflecting part of said light component which does not directly impinge on said first focusing means toward said first focusing means, and directing the reflected part toward a third region at a location along said first region; and second fixed reflecting means for reflecting light reflected from said third region and focused by said second focusing means to cause the reflected and focused light to impinge on said light-receiving means.

15. The door sensor system according to claim 14 wherein the optical axes of said light-emitting means and light-receiving means are so positioned that substantially equal amounts of light impinge on said first variably tiltable reflecting means and said first fixed reflecting means and that said light-receiving means receives substantially equal amounts of light from said second variably tiltable reflecting means and said second fixed reflecting means.

16. The door sensor system according to claim 11 wherein each of said first and second focusing means is a plano-convex lens having its convex surface facing said floor, said lens having a straight edge facing said door, said straight edge being generally parallel to said door.

17. The door sensor system according to claim 16 wherein said light-emitting means and said light-receiving means are located above said straight edges of said respective plano-convex lenses.

* * * * *